US005587008A

United States Patent [19]

LaFay et al.

[11] Patent Number: 5,587,008

[45] Date of Patent: Dec. 24, 1996

[54] SAND MOLDING MEDIA FOR IRON CASTINGS

[75] Inventors: Victor S. LaFay, Cincinnati, Ohio; Stephen L. Neltner, Alexandria, Ky.

[73] Assignee: Hill & Griffith Co., Cincinnati, Ohio

[21] Appl. No.: 556,740

[22] Filed: Nov. 7, 1995

[51] Int. Cl.[6] ..... B22C 1/02

[52] U.S. Cl. ..... 106/38.51; 106/38.23; 106/38.8; 106/38.9; 164/520

[58] Field of Search ..... 164/520, 523; 106/38.23, 38.27, 38.28, 38.51, 38.8, 38.9

[56] References Cited

FOREIGN PATENT DOCUMENTS 1106555 8/1981 Canada ..... 164/520

409769 1/1974 U.S.S.R. ..... 164/520

1342583 10/1987 U.S.S.R. ..... 164/520

*Primary Examiner*—Kuang Y. Lin

*Attorney, Agent, or Firm*—Kinney & Schenk

[57] ABSTRACT

A sand molding medium for the use in founding of iron. The medium includes wettable uintaite as a carbon source supplemental to sea coal. The wettable uintaite is included in a carbon additive that is combined with sea coal to formulate the carbon component of an a pre-mix. The pre-mix also includes a clay component. The pre-mix is combined with sand to formulate the sand molding medium.

10 Claims, No Drawings

SAND MOLDING MEDIA FOR IRON CASTINGS

BACKGROUND OF THE INVENTION

The present invention relates to improvements in the founding of iron and more particularly to improvements in sand molding media employed in forming molds into which molten iron is poured in the production of castings.

Founding is an ancient art in which a cavity is defined in a sand mold and then molten metal poured therein. After the metal cools, the cast article is removed, with the sand mold usually being broken up in the removal process. The usual and basic procedure for forming such sand molds is to compact a sand molding medium around a pattern and then to remove the pattern, leaving a cavity having the configuration of the pattern.

In order for the sand to maintain its molded, cavity defining configuration, it is necessary to provide a binding agent that will cause the sand particles to cohere. Clay has long been an accepted and suitable binding agent. Clay denotes a large group of hydrous alumino-silicate minerals. Individual mineral grains go down to microscopic size. When dampened, clay is tenacious and plastic. When dampened and then dried clay becomes permanently hard, particularly when dried at elevated temperatures.

The present invention is specifically directed to the founding of iron, where so-called green sand casting is a standard practice. This term denotes a process wherein molten metal is poured into a sand mold while it still retains the moisture that has been added to actuate the cohesive properties of the clay. Sand molding media for iron founding comprise three basic components, namely sand, clay and finely ground anthracite, commonly known in the trade as "sea coal". In use, a sand molding medium is moistened with water to provide a medium that is capable of being compacted around a pattern to form a mold cavity. After removal of the pattern, molten iron is poured into the mold cavity while the sand molding medium is still in its dampened or "green" condition. The sea coal, on and immediately adjacent the mold cavity surface, decomposes under the heat of the molten iron, as it is poured into the mold. A product of this decomposition is elemental iron, in the form of graphite, at the interface between the mold cavity and the poured iron. This elemental graphite serves the primary function of enabling the solidified casting to be released from the mold, free of sand particles. A secondary benefit of the elemental graphite is that it tends to level the surface of the mold cavity, thereby producing a smoother surface on the cast article.

In more recent times, it has been recognized that various advantages can be realized by substituting alternate carbon sources for a portion of the sea coal. Thus, there have been various proposals to employ bitumens, such as asphaltic emulsions, asphaltene chips, petroleum pitch and uintaite (a naturally occurring asphaltic deposit found in the Uinta Mountains in Utah and. available for the American Gilsonite Co., Salt Lake City, Utah, under the trademark Gilsonite). The use of such alternate, or secondary, bitumens is discussed in a paper, by the present inventors, published in the Journal of the American Foundrymans Society, Vol 95, pages 133–138 (Date of publication 1978).

At this point, it will be briefly noted that it is a well established practice of the trade for a foundry to purchase a "pre-mix", which comprises a clay component and sea coal. The foundry then mixes the "pre-mix" with sand from a local source to provide the sand molding media required for its operations.

At least one pre-mix having a supplemental bitumen has been commercially available for several years. This is to reference the use of an asphaltic (complex hydrocarbon) product which is derived from the distillation of petroleum. This petroleum based asphalt is employed in the form of an emulsion, i.e., the asphalt is a supercooled liquid in a highly dispersed emulsion. One advantage of this asphaltic emulsion is that it is richer in carbon than anthracite coal, that is, a lesser quantity of the asphaltic emulsion is required for a given quantity of sand molding medium.

It is to be noted that sand molding media employing either coal alone, or coal in combination with a supplemental carbon source, viz., the referenced asphaltic emulsion, have adequate strength characteristics for molding operations. This is to bring to attention the fact that the cohesive strength of the sand molding medium is most critical in its "green" condition, that is, when it is moistened. After being compacted to define a cavity, the "green" molding medium must have sufficient strength to withstand any forces incident to removal of a pattern, so that the cavity configuration is maintained intact. Next, sand molding media, when in a green stage, must have sufficient strength to withstand the forces incident to the mold being moved and repositioned in various fashions in the process preparing it for the pouring of metal into the cavity. Further, the sand molding media must have sufficient cohesive strength to withstand the hydraulic forces incident to pouring molten iron into the cavity.

Drying of a "Green" mold occurs extremely rapidly and can occur while the metal is still molten and continues to exert hydraulic forces on the mold structure. The dry strength of the molding medium is therefore critical in assuring that the integrity of the mold will be maintained to the end of obtaining cast articles of the proper configuration.

It will be briefly mentioned that there is another significant, objective characteristic of sand molding media, namely, permeability. A relatively high permeability is required in order to prevent damage to the mold when molten iron is poured into the mold cavity. This is to point out that when molten metal is poured into the mold cavity, air must be displaced though the mold medium. More importantly, because the sand molding medium is damp, steam can be generated in a rather violent, or explosive, fashion. Such steam must be vented through the molding medium with a minimum of gas flow resistance. All of this requires a porous mold structure having a relatively high gas permeability.

Strength characteristics and permeabilities are capable of objective determination and acceptable green and dry strengths for sand molding media, as well as permeabilities, are now established.

After an item has been cast, the sand mold is broken up and then recomminuted for reuse. Over a period of time it becomes necessary to add fresh amounts of the clay and carbon additive. Similarly, it is a common practice to also add fresh sand. This not only maintains a more or less constant ratio of the sand, clay and carbon components, but also compensates for the accumulation of ash that is a byproduct of the decomposition of the sea coal.

The referenced pre-mix, that includes an asphaltic emulsion, has found acceptance because of several advantages. Primarily these advantages are found in the ability to minimize costs by the use of less pre-mix and/or by reducing the total amount of carbonaceous material in the pre-mix. Further, it was demonstrated that the amount of additional, "make-up" pre-mix, needed in recycling a sand molding medium, was reduced. Additionally it was demonstrated that this hybrid hydrocarbon pre-mix gave improved compactability, which facilitated forming molds, as well as minimizing the number of faulty castings. These advantages were attained, while at the same time maintaining the necessary, minimum green and dry strengths. Also, the gas permeability characteristics were sufficient to properly vent the molds when the molten iron was cast.

Another factor to note is that as green sand molding medium is compacted around a pattern (in the normal case) to form a mold cavity. The characteristics of the sand molding medium can have a great impact on the "workability" of the medium and the ability to compact, viz., densify, the medium and also the ease with which densification can be attained. This factor is relevant to the fact that both the green strength and dry strength of a sand molding medium are directly proportionate to the density of the sand molding medium after it has been compacted to define a mold cavity. There is thus a preference for sand molding media that have a workability characteristic which facilitates obtaining a desired, relatively high and consistent density of the compacted molding medium. While the "workability" characteristic is subjective, it is, nonetheless, a recognized standard for sand molding media.

The referenced, petroleum based, asphaltic emulsions have a limited number of commercial applications, or uses, beyond its use in sand molding media. Therefore, there is little stimulus for widespread availability of this product. Thus there is an absence of price competition. For this and other reasons, such emulsions can be difficult to obtain in desired quantities and, in all events, are relatively expensive. A further shortcoming with this asphaltic emulsion is that the petroleum derived asphaltic product emits benzene, when it decomposes under the heat of molten iron. While there has been no demonstrated hazard from such benzene emissions, benzene is deemed undesirable, if not harmful, in many situations. Recognizing that governmental regulations are often imposed where no realistic hazard exists, it is prudent and desirable to greatly minimize, if not eliminate benzene emissions from this aspect of foundry operation.

The present invention focuses on pre-mixes employing sea coal and an alternate carbon source. In a more specific sense, the invention seeks to overcome problems and shortcomings associated with employing emulsions of petroleum based asphalt.

A primary object of the invention is to provide a supplemental, carbon rich, hydrocarbon source for sand molding media employed in the founding of iron.

Another object of the invention is to achieve the foregoing end and, additionally, to greatly minimize, if not eliminate the emission of benzene during decomposition of the hydrocarbon in the casting process.

Yet another object of the invention is to achieve the foregoing ends in a manner that preserves the necessary characteristics of a sand molding medium for use in iron founding.

A further object of the present invention is to attain the foregoing ends and, additionally, to further improve the facility with which sand molding media can be densified to thereby provide increased strength for the sand molding medium on a more consistent basis.

SUMMARY OF THE INVENTION

For purposes of providing terms of reference herein, a sand molding medium is defined as comprising silica sand and a pre-mix. On a weight basis, a sand molding medium can comprise 85%–95% silica sand, and 5%–15% pre-mix. The usual and more preferred composition is 90%–93% silica sand and 7%–10% pre-mix.

The sand molding media of the present invention are intended for use in founding of iron and, for reasons discussed above, include a carbon component which decomposes to elemental iron, in the form of graphite, when exposed to the heat of molten iron in the casting process. The pre-mix thus comprises a carbon component and a clay component. Where the carbon component is comprised solely of sea coal the pre-mix may comprise 70%–85% clay component and 15%–30% sea coal (the carbon component).

Where a supplemental carbon source is employed, the carbon component comprises sea coal and a "carbon additive". In the prior art, this "carbon additive" has comprises the referenced, petroleum derived asphalt, in the form of an asphaltic emulsion. It will also be noted that the prior art teaches that the inclusion of a high molecular weight, acrylic emulsifier (ref. Ex. 2) in a very small amount as a component of the "carbon additive" to enhance the effectiveness of the asphaltic emulsion.

Where the carbon content of a sand molding medium is to be provided solely by sea coal, the sea coal (carbon component) and clay (clay component) are simply mixed together and blended to form a "pre-mix". Foundries purchase such "pre-mixes" and then add and blend them with locally acquired sand to prepare a sand molding medium.

Where a supplemental carbon source is employed, a "carbon additive" is prepared and added to sea coal to form a "carbon component". Where an emulsifier is employed, it is also added to the "carbon additive". The "carbon additive" may then be mixed with sea coal in forming the "carbon component".

It would also be possible for the "carbon component" or the "carbon additive" to be separately marketed. Foundries could then purchase sea coal and/or clays to formulate their own "pre-mixes".

The ends of the present invention may be realized through the inclusion of wettable uintaite, rather than a petroleum derived asphalt in the carbon component of the pre-mix employed in formulating a sand molding medium.

In a broader sense, the invention the invention goes to a sand molding medium comprising 85%–95% silica sand and 5%–15% pre-mix. The pre-mix includes a clay component and a carbon component. The clay component may comprise 70%–85% of the pre-mix and the carbon component may comprise 15% to 30% of the pre-mix. The carbon component may then comprise 25%–85% sea coal and 75%–15% carbon additive. The carbon additive may comprise 25%–100 wettable uintaite.

While uintaite had previously been employed as a secondary or supplemental carbon source in sand molding media, its use did not find acceptance to any substantial extent. Uintaite, as previously used, was not "wettable". While non-wettable uintaite, does substantially reduce, or eliminate, the benzene problem of petroleum derived asphalt, it does not offer the same advantages as the petroleum derived asphalt. This is to say that the non-wettable uintaite does not provide the same ease of compaction and molding, does not provide similar green/dry strengths or permeability, does not reduce the amount of "make-up" pre-mix, or "make-up" carbon additive, needed for recycling sand molding media.

Wettable uintaite is available from the American Gilsonite Co., Salt Lake City, Utah, under the designation "wettable Gilsonite" (Gilsonite is the trademark of American Gilsonite Co.). Wettable Gilsonite is simply uintaite that has been treated with a surfactant to provide a wettable characteristic. The wettable characteristic however has been found to render uintaite a highly effective ingredient in improving the characteristics of sand molding media.

Sand molding media which include wettable uintaite likewise substantially minimize, if not eliminate, benzene emissions during the founding process. Further the use of wettable uintaite provides substantially the same advantages as are found in the use of petroleum derived asphalt, if not actually enhancing such advantages. Additionally, it has been found that wettable uintaite dispersions may be, generally, substituted, on an equal weight basis, for the petroleum based asphaltic emulsions. Such direct substitutions do not, necessarily, provide the best results that can be obtained through the use of wettable uintaite, but they do, at the lease, substantially minimize, if not eliminate benzene emissions.

Where wettable uintaite is included in the carbon component of the pre-mix, it could comprises 100% of the "carbon component". Economic and other factors, make advantageous a "carbon component" comprised of sea coal and a carbon additive, with the wettable uintaite being included, as a supplemental carbon source in the "carbon additive". The preferred composition of the "carbon component" is sea coal 74%–86% and "carbon additive" 14% to 26%, with the wettable uintaite solids being 3% to 39% of the seal coal weight.

A further advantage of the wettable uintaite is that it is compatible with clays that are conventionally used with and have been found reliable in providing the necessary strengths for iron, sand molding medium. Thus, it is preferred that the "clay component" of the "pre-mix" comprise approximately 50% southern bentonite and 50% western bentonite see Ex. 1).

In a more specific sense, the ends of the invention are attained by an emulsion of the wettable uintaite, preferably including an small amount of a high molecular weight, an acrylic emulsifier, as was done with the petroleum derived asphalt.

Additional advantages are found in the inclusion of dextrin in the "carbon additive". The amount of dextrin may vary from 1% to 10% as a weight percentage of the "carbon additive".

It is to be noted that dextrin has previously been employed as a component of sand molding media for steel castings. Steel sand molding media are distinguished from iron sand molding media in that the former do not have a carbon content. The function of the dextrin in the present invention is to further enhance compactability of the sand molding medium, while at the same time increase their green and dry strengths. These ends are attained in the specified range of 1%–10% of the "carbon additive". In contrast, when dextrin is used in steel, sand molding media, the function of the dextrin varies in that its purpose is to improve flowability of the sand molding medium in which it is incorporated and/or the amounts of dextrin employed are substantially higher.

Finally, it will be pointed out that constituents of the iron sand molding media are herein expressed, as a matter of convenience, in terms of a medium first comprising sand and a "pre-mix" in a given range of proportions; the pre-mix is then defined as comprising a clay component and a carbon component in a stated range of proportions; the carbon component is then defined in terms of a sea coal component and a "carbon additive" component, again in a given range of proportions; finally the "carbon additive" component is defined in terms of a supplemental carbon source (wettable uintaite in the case of the present invention) and other optional components. This type of definition is employed in light of the fact that a "pre-mix" is an article of commerce, that is normally acquired by a foundry to be mixed with locally acquired sand in preparing an iron, sand molding medium. A "pre-mix" can also be employed as a "make up" constituent in recycling iron, sand molding media. Similarly, the "carbon component" or "carbon additive" could be separately acquired by a foundry for mixing with independently acquired clays and/or sea coal in the formulation of a "pre-mix" or they could be separately added to as "make up" constituents to independently control the sea coal/wettable uintaite/clay ratios.

The scope of the present invention is not limited to separately forming the "carbon additive", "carbon component", "pre-mix" to the end of providing a sand molding medium. This is to say that the several constituent, in proper amounts, could be simultaneously mixed in a container to form the sand molding medium of the present invention.

DETAILED DESCRIPTION OF THE INVENTION

In further describing the invention, the several specific examples will be given. Each example comprise a batch of sand molding medium intended for use in forming moldings to be used in the casting of iron articles. The batches of sand molding media in the several examples have commonalities, which facilitate an appreciation of the improvements of the present invention.

With the exception of two batches, the total weight of each batch of sand molding medium is 20 pounds. The exceptions are found in Examples 1A and 2, each of which has a weight of 15 pounds.

Each batch is comprised of a "pre-mix" that includes a "clay component" and a "carbon component". The "clay component" comprises 7% of the total weight of the batch—1.4 pounds (635 grams) for the 20 pound batches and 1.05 pounds (476 grams) in the 15 pound batches. The "clay component" also has the commonality of each comprising 50% southern bentonite clay (also known as montmorillonite) and 50% western bentonite clay. The southern bentonite originates from natural clay deposits in the region of Sandy's Ridge, Ala. and is characterized by aluminum silicates in which calcium is the principal attached ion. The western bentonite originates from natural clay deposits in the region of Colony, Wyo. and is characterized by aluminum silicates in which sodium is the principal attached ion. These clays have been long used in sand molding media and their effectiveness is well proven.

In each if the examples the balance of the batch, the "pre-mix" is added to and is further comprised of common #410 silica sand. The sand and "pre-mix" are blended to form the molding sand medium for the example.

In each example water in the amount of some 1.0%–2.0% of the weight of the sand molding medium was added to moisten the medium to bring it to a green stage. The green sand molding medium of each example was then tested to determine its objective physical characteristics of "green strength", "dry strength" and "permeability". These characteristics were determined following testing procedures established by the American Foundrymen's Society. In each example, the sand molding medium, in its green stage, is molded into a plurality of cylinders having a diameter of two inches and a height of two inches. The cylinders were compacted to different densities to provide samples weighing 150 grams, 155 grams, 160 grams and 165 grams. The following test procedures were then performed:

| | |
|---|---|
| AFS 202-87-S | Green Compression Strength (pounds per sq. inch) |
| AFS 203-87-S | Dry Compression Strength (pounds per sq. inch) |
| AFS 203-87-S | Mold Permeability (Flow rate proportional to count) |

A chart is provided for each example, giving the strengths and permeabilities for the different densities of the tested samples.

EXAMPLE 1

The first example provides a bench mark for a basic sand molding medium comprised only of sand and a clay additive. For purposes of terms of reference, a sand molding medium is defined as comprising a "pre-mix", which is added to the basic sand component. In this bench mark example, the pre-mix comprises 100% clay.

The composition of the batch was:

| Batch 1 | Per Cent | Pounds | Grams |
|---|---|---|---|
| Sand | 93.0 | 18.6 | 8454 |
| Pre-mix | 7.0 | 1.4 | 635 |
| Pre-mix: | | | |
| Clay# | 100.0 | 1.4 | 635 |

#50% southern bentonite obtained from natural clay deposits in the region of Sandy's Ridge, Alabama; 50% western bentonite obtained from clay deposits in the region of Colony, Wyoming.

The objective test results were:

| Weight (g) | Green Strength (psi) | Dry Strength (psi) | Permeability |
|---|---|---|---|
| 150 | 6.9 | 7.0 | 415 |
| 155 | 7.6 | 13.0 | 333 |
| 160 | 11.2 | 17.0 | 255 |
| 165 | 15.6 | 29.0 | 209 |

It is well known that a sand molding medium, absent a carbon additive is not suitable for founding of iron. This examples provides a baseline against which the affect of carbon additives can be judged. That is, this baseline illustrates the strengths and permeability of a given clay additive. An acceptable carbon additive would, at the worst, cause a minimal decrease in the green and dry strengths, as well as a minimal decrease in the permeability of a sand molding medium in which it is included. Ideally, the carbon additive would increase at least one of these objective characteristics, and, more ideally would increase all of these characteristics. The examples will show that increases in both green and dry strengths can be obtained by the carbon additives of the present inventions.

EXAMPLE 1A

The purpose of this example is to provide a baseline reference for the characteristics of a conventional sand molding medium where sea coal is the sole source for providing the elemental graphite necessary for founding of iron. It will be noted that in this and all of the remaining examples herein the "pre-mix" comprises a "clay" component and a "carbon component". In this example, the "carbon component" is comprised of 100% sea coal.

| Batch 1A | Per Cent | Pounds | Grams |
|---|---|---|---|
| Sand | 91.25 | 13.69 | 6210 |
| Pre-mix | 8.75 | 1.31 | 595 |
| Pre-mix: | | | |
| Clay Component# | 80.0 | 1.05 | 476 |
| Carbon Component | 20.0 | .26 | 118 |
| Carbon Component: | | | |
| Sea Coal | 100.0 | .26 | 118 |

#See Ex. 1

The batch was moistened to form a green sand molding medium that was then molded into cylinders for performance of the object characteristics. The sand molding medium of this example handled and was compactable in the fashion that is normally associated with the forming of molds for iron castings. The results of the objective tests were:

| Weight (g) | Green Strength (psi) | Dry Strength (psi) | Permeability |
|---|---|---|---|
| 150 | 6.0 | 14.8 | 118 |
| 155 | 8.5 | 26.3 | 93 |
| 160 | 12.9 | 36.5 | 73 |
| 165 | 16.8 | 47.4 | 59 |

EXAMPLE 2

This example illustrates the above discussed use of an alternate carbon source in addition to sea coal in providing the elemental carbon source that is necessary for casting iron. This is the current, state of the art, sand molding medium, which the present invention seeks to improve.

| Batch 2 | Per Cent | Pounds | Grams |
|---|---|---|---|
| Sand | 91.15 | 13.67 | 6202 |
| Pre-mix | 8.85 | 1.33 | 602 |
| Pre-mix: | | | |
| Clay Component# | 79.13 | 1.05 | 476 |
| Carbon Component | 20.87 | .263 | 118 |
| Carbon Component: | | | |
| sea coal | 80.0+ | 0.197 | 88 |
| additive | 20.0+ | .066 | 30 |
| Additive: | | | |
| asphaltic emulsion* | 100.0 | 0.066 | 30 |
| solids | (50.0) | .033 | 15 |
| water | (50.0) | .033 | 15 |
| emulsifier**. | .1 | .00008 | .036 |

+Emulsifier disregarded

#See Ex. 1

*The asphaltic emulsion is a water emulsion of comminuted asphalt derived from the distillation of petroleum and is commercially available from the Ashland Oil Company, Ashland, Kentucky, under the trademark BB2+. The emulsion is formed at an elevated temperature, with the asphalt being in a supercooled form at room temperature.

**The high molecular weight acrylic emulsifier is commercially available from the B.F. Goodrich, Calvert City, Kentucky under the trademark Carbopol 941. Because of the small amount involved, the weight of the acrylic emulsifier is not indicated in rounding out the total weight of the carbon additive and the total weight of the batch. The same treatment of its weight is found in other examples.

The constituents of the additive were first mixed. The additive and the sea coal are then mixed and then the clay component was added to form the pre-mix. The pre-mix was then blended into the sand component of the sand molding medium.

For purpose of further providing a data baseline, the objective, physical characteristics of Batch 2 were determined as follows:

| Weight (g) | Green Strength (psi) | Dry Strength (psi) | Permeability |
|---|---|---|---|
| 150 | 5.3 | 15.5 | 118 |
| 155 | 8.3 | 22.5 | 95 |
| 160 | 11.8 | 26.4 | 72 |
| 165 | 16.6 | 36.3 | 58 |

The pre-mix employed in Batch 2 is a commercially available item. This sand molding medium is representative of what would be employed in a typical foundry. The working characteristics (compactability, ease of handling, etc.) of this sand molding medium, employing sea coal and an additive that includes a petroleum derived asphalt, as a supplemental carbon source, are well known. The inclusion of this additive also provides improvements in working characteristics over media in which sea coal is the sole carbon source. The working characteristics of this batch are the baseline for gauging the working characteristics desired in evaluating the sand molding media provided by the present invention.

It is further well known that, the petroleum derived asphalt, under the heat of molten iron, decomposes to form a portion of the elemental iron necessary for the casting of iron articles. Further, when this additive (with a petroleum derived asphalt) is employed the "make-up" amounts of "pre-mix" are substantially reduced. It is additionally well established that benzene is emitted during this decomposition process.

EXAMPLE 2A

In evaluating the alternate, supplemental carbon sources for use in sand molding media, it is an accepted practice to omit the seal coal portion of the carbon component of the "pre-mix" and to substitute, in its stead, an additional amount of clay. The correlation of data is evidenced by Example 2A, which is equivalent to Example 2, but omits the sea coal content of that example. In effect, an additional amount of clay has been substituted for the sea coal.

Thus, Batch 2A comprises:

| Batch 2A | Per Cent | Pounds | Grams |
|---|---|---|---|
| Sand | 91.6 | 18.52 | 8400 |
| Pre-mix | 7.4 | 1.48 | 672 |
| Pre-mix: | | | |
| Clay Component# | 94.6 | 1.40 | 636 |
| Carbon Component (100% Additive) | 5.4 | .08 | 36 |
| Additive: | | | |
| asphaltic emulsion* | 100.0+ | .08 | 36 |
| solids | (50.0) | .04 | 18 |
| water | (50.0) | .04 | 18 |
| emulsifier**. | .1+ | .00008 | .036 |
| +Emulsifier disregarded | | | |

#See Ex. 1;
*,**See Ex. 2

The constituents of this batch were mixed in the same fashion as in example 2 and the following objective, physical characteristics were established:

| Weight (g) | Green Strength (psi) | Dry Strength (psi) | Permeability |
|---|---|---|---|
| 150 | 5.8 | 6.0 | 410 |
| 155 | 8.0 | 12.5 | 330 |
| 160 | 11.3 | 25.0 | 242 |
| 165 | 15.9 | 29.0 | 203 |

The remaining examples set forth sand molding media formulations which teach additives that provide, at least, essentially the same advantages as the prior art, asphaltic emulsion additives, while at the same time substantially minimizing, if not eliminating benzene emissions.

In these examples (Batches 3–13) the sea coal component has been omitted and the respective examples have been evaluated on the basis of the "additive" alone, with respect to the prior art "additive" example in Example 2A. The workability characteristics of Batch 3 (Ex. 3) were further evaluated by testing of sand molding media that includes sea coal to further verify that the physical and workability characteristics of additives without sea coal predict would will be experienced when sea coal is included.

EXAMPLE 3

A twenty pound batch (Batch 3) of sand molding medium was prepared with the following composition:

| Batch 3 | Per Cent | Pounds | Grams |
|---|---|---|---|
| Sand | 92.6 | 18.52 | 8400 |
| Pre-mix | 7.4 | 1.48 | 672 |
| Pre-mix: | | | |
| Clay Component# | 94.6 | 1.40 | 636 |
| Carbon Component (100% Additive) | 5.4 | .08 | 36.3 |
| Additive: | | | |
| powdered uintaite*** | 47.5+ | .038 | 17.2 |
| water | 47.5+ | .038 | 17.2 |
| canary yellow dextrin**** | 5.0+ | .004 | 1.8 |
| emulsifier**. | .1 | .00008 | .036 |
| +Emulsifier disregarded | | | |

#See Ex. 1;
**See Ex. 2
***Uintaite is a naturally occurring asphalt founding the Uinta River Valley in Utah, available from American Gilsonite Company, Salt Lake City, Utah. The uintaite used in this and other examples herein was modified by the addition of a surfactant and identified as wettable Gilsonite.
****Dextrin is a soluble polysaccharide obtained from starch. The designation "Yellow Canary" is a type designation, indicating a high cold water solubility. This dextrin is available from National Starch Company, Indianapolis, Indiana.

The components of the of the carbon component (additive) were thoroughly mixed as a dispersion and then mixed with the clay component. The combined clay and carbon additives were then blended with the sand to form a sand molding medium (Batch 3). This sand mold medium, with a water content of 2.0% was then formed into test specimens, which were tested in the fashion described in the prior examples, with the following results:

| Weight (g) | Green Strength (psi) | Dry Strength (psi) | Permeability |
|---|---|---|---|
| 150 | 5.1 | 15.5 | 420 |
| 155 | 7.5 | 23.5 | 337 |
| 160 | 11.2 | 37.0 | 240 |
| 165 | 14.1 | 50.0 | 194 |

Laboratory tests were run on the uintaite, which demonstrated that it was substantially free of benzene emissions when subject to thermal decomposition, thereby confirming that one object of the present invention had been met.

The "additive" of Batch 3 was also employed in more extensive field testing. A batch of several hundred pounds (weight correct?) was prepared for use at a foundry. The formulation of this larger batch was essentially the same as for batch 3, excepting that the "carbon component" of the "pre-mix" comprised 80% sea coal and 20% of the wettable uintaite "additive". This larger batch of sand molding medium was employed in forming molds which were then used in the founding of iron castings. The workability of the larger batch confirmed that its characteristics were at least equal to those possessed by the sand molding media using conventional, asphaltic based "additives". It was further determined that the strength/permeability characteristics were sufficient to permit forming of mold cavities that produced suitable castings using the procedures normally employed in a conventional foundry operation. Additionally, the larger batch testing confirmed that the workability characteristics were as predicted by the "additive" only testing and that the workability characteristics were at least as good, and in some aspects better than those produced when the additive was based on petroleum based asphalts.

Further, in the large scale testing, the sand molding medium was recycled, through the use of make-up amounts of "pre-mix". It was determined that lesser amounts of "make-up" pre-mix were required, as compared to pre-mixes that do not include an additive. It was also determined that the amount of "make-up" pre-mix was roughly comparable to that required where the pre-mix includes a petroleum based, additive.

Additionally, in the foundry testing of the Batch 3 additive, the area was monitored for benzene emissions, with no amounts of benzene being detected.

EXAMPLE 4

A twenty pound batch (Batch 4) of sand molding medium was prepared with the following composition:

| Batch 4 | Per Cent | Pounds | Grams |
|---|---|---|---|
| Sand | 92.6 | 18.52 | 8400 |
| Pre-mix | 7.4 | 1.48 | 672 |
| Pre-mix: | | | |
| Clay Component# | 94.6 | 1.40 | 636 |
| Carbon Component (100% Additive) | 5.4 | .08 | 36.3 |
| Additive: | | | |
| powdered uintaite*** | 47.5+ | .04 | 17.3 |
| water | 47.5+ | .04 | 17.3 |
| canary yellow dextrin**** | 5.0+ | .004 | 1.4 |
| emulsifier**. | .1 | .00008 | .036 |

+Emulsifier disregarded

#See Ex. 1;
**See Ex. 2;
*,**See Ex. 3

The components of Batch 4 are the same as in Batch 3. Batch 4 differed from Batch in that the dry ingredients of the clay component and the carbon component (additive) were first mixed and blended. The water content was then added to this dry mixture, providing a moistened pre-mix, as opposed to the wettable unitaite additive dispersion that was first provided in Example 3. The moistened pre-mix was then mixed with the sand component of the medium to form Batch 4.

This sand mold medium (Batch 4), with a water content of 1.8% was then formed into test specimens, which were tested in the fashion described in the prior examples, with the following results:

| Weight (g) | Green Strength (psi) | Dry Strength (psi) | Permeability |
|---|---|---|---|
| 150 | 7.4 | 11.0 | 420 |
| 155 | 9.2 | 12.5 | 345 |
| 160 | 13.4 | 33.0 | 260 |
| 165 | 17.0 | 43.0 | 210 |

The conclusion reached was that there was no significant difference in forming the "additive" as a water dispersion of the wettable unitaite or in simply adding the wettable uintaite in dry form to the clay component of the pre-mix.

EXAMPLE 5

A batch of sand molding medium (Batch 5) was prepared with the same composition as Batch 3 of Example 3, and in the same fashion, excepting that the high molecular weight acrylic polymer (Carbopol 941) was omitted.

| Batch 5 | Per Cent | Pounds | Grams |
|---|---|---|---|
| Sand | 92.6 | 18.52 | 8400 |
| Pre-mix | 7.4 | 1.48 | 672 |
| Pre-mix: | | | |
| Clay Component# | 94.6 | 1.40 | 636 |
| Carbon Component (100% Additive) | 20.0 | .08 | 36.3 |
| Additive: | | | |
| powdered uintaite*** | 47.5 | .038 | 17.3 |
| water | 47.5 | .038 | 17.3 |
| canary yellow dextrin**** | 5.0 | .004 | 1.4 |

#See Ex. 1;
*,**See Ex. 3

This sand mold medium (Batch 5), was appropriately dampened and then formed into test specimens, which were tested in the fashion described in the prior examples, with the following results:

| Weight (g) | Green Strength (psi) | Dry Strength (psi) | Permeability |
|---|---|---|---|
| 150 | 8.2 | 8.5 | 330 |
| 155 | 9.9 | 16.3 | 270 |
| 160 | 13.6 | 24.7 | 210 |
| 165 | 18.0 | 32.7 | 170 |

The results of this example confirmed the preference for employing a high molecular weight, acrylic emulsifier in the "additive". The workability and objective testing indicate that satisfactory sand molding media can be provided without this emulsifier. However, workability characteristics, in particular, are improved when it is employed.

EXAMPLES 6 & 7

Examples 6 and 7 illustrate the affects of varying the amount of uintaite in the carbon additive.

In Example 3 the uintaite and water amounts were equal. In examples 6 and 7, the total weight of uintaite and water is maintained the same, with a 1:3 ratio of uintaite to water in Example 6 and a 3:1 ratio of uintaite to water in Example 7.

In example 6 twenty pound batch (Batch 6) of sand molding medium was prepared with the following composition:

| Batch 6 | Per Cent | Pounds | Grams |
|---|---|---|---|
| Sand | 92.6 | 18.52 | 8400 |
| Pre-mix | 7.4 | 1.48 | 672 |
| Pre-mix: | | | |
| Clay Component# | 94.6 | 1.40 | 636 |
| Carbon Component (100% Additive) | 20.0 | .08 | 36.3 |
| Additive: | | | |
| powdered uintaite*** | 23.75+ | .019 | 8.6 |
| water | 71.25+ | .057 | 25.9 |
| canary yellow dextrin**** | 5.0+ | .004 | 1.8 |
| emulsifier** | .1 | .00008 | .036 |
| +Emulsifier disregarded | | | |

#See Ex. 1;
**See Ex. 2;
*,**See Ex. 3

The components of the of the carbon additive were thoroughly mixed as a dispersion and then mixed with the clay component to form the pre-mix. This pre-mix was combined with the sand to form a sand molding medium (Batch 6). This sand molding medium, was then dampened and formed into test specimens, which were tested in the fashion described in the prior examples, with the following results:

| Weight (g) | Green Strength (psi) | Dry Strength (psi) | Permeability |
|---|---|---|---|
| 150 | 9.2 | 22.0 | 387 |
| 155 | 12.1 | 31.0 | 305 |
| 160 | 16.8 | 49.0 | 230 |
| 165 | 20.0 | 50.0 | 188 |

In Example 7, a twenty pound batch (Batch 7) of sand molding medium was prepared with the following composition:

| Batch 7 | Percent | Pounds | Grams |
|---|---|---|---|
| Sand | 92.6 | 18.52 | 8400 |
| Pre-mix | 7.4 | 1.48 | 672 |
| Pre-mix: | | | |
| Clay Component# | 94.6 | 1.40 | 636 |
| Carbon Component (100% Additive) | 20.0 | .08 | 36.3 |
| Additive: | | | |
| powdered uintaite*** | 23.25+ | .057 | 25.9 |
| water | 71.75+ | .019 | 8.6 |
| canary yellow dextrin**** | 5.0+ | .004 | 1.8 |
| emulsifier**. | .1 | .00008 | .036 .18 |

+Emulsifier disregarded
#See Ex. 1;
**See Ex. 2;
*,**See Ex. 3

These component were then combined, in the same fashion as in the previous example to form a sand molding medium (Batch 7). Objective physical characteristics were determined as:

| Weight (g) | Green Strength (psi) | Dry Strength (psi) | Permeability |
|---|---|---|---|
| 150 | 5.8 | 4.0 | 356 |
| 155 | 7.3 | 9.0 | 280 |
| 160 | 11.2 | 18.5 | 210 |
| 165 | 14.8 | 33.0 | 170 |

From a standpoint of strength and permeability, both Batches 6 and 7 would satisfy the requirements for a sand molding medium. However, the reduced amount of wettable uintaite in Example 6, with a concomitant increase in both green and dry strengths evidences that reduced amounts of wettable uintaite could be preferred, not only because of the economic advantage, but for forming molds having thin wall sections. The higher percentage of wettable uintaite used in Example 3 is still preferred in that amount of wettable uintaite provides somewhat better workability characteristics.

EXAMPLES 8–13

Examples 8–13 are provided to give a better understanding of the affects of dextrin in sand molding media of the present invention.

In Examples 8–13 a twenty pound batch (Batch 8) of sand molding medium was prepared with the following basic composition:

| Basic Composition (Batches 8–13) | Percent | Pounds | Grams |
|---|---|---|---|
| Sand | 92.6 | 18.52 | 8400 |
| Pre-mix | 7.4 | 1.48 | 672 |
| Pre-mix: | | | |
| Clay Component# | 94.6 | 1.40 | 636 |
| Carbon Component (Additive) | 20.0 | .08 | 36.3 |

#See Ex. 1;

The composition of the additive was then varied for the batches of Examples 8–13. The batches of each of Examples 8–13 were formulated and tested in the same fashion as Batch of Example 3. Batch 8 has the same formulation as Batch 3, excepting that the dextrin component is omitted, to provide a baseline on the effects of dextrin. In each of the remaining examples (9–13) the amount of dextrin is increased in 2% increments.

In Example 8 the "additive" composition was:

| Additive - Batch 8 | | | |
|---|---|---|---|
| Additive: | | | |
| powdered uintaite*** | 50.0+ | .04 | 18.15 |
| water | 50.0+ | .04 | 18.15 |
| emulsifier**. | .1 | .00008 | .036 |
| **Additive - Batch 9** | | | |
| Additive: | | | |
| powdered uintaite*** | 49.0+ | .0392 | 17.79 |
| water | 49.0+ | .0392 | 17.79 |

-continued

| | | | |
|---|---|---|---|
| canary yellow dextrin**** | 2.0+ | .0016 | .72 |
| emulsifier**. | .1 | .00008 | .036 |
| Additive - Batch 10 | | | |
| Additive: | | | |
| powdered uintaite*** | 48.0+ | .0384 | 17.43 |
| water | 48.0+ | .0384 | 17.43 |
| canary yellow dextrin**** | 4.0+ | .0032 | 1.44 |
| emulsifier**. | .1 | .00008 | .036 |
| Additive - Batch 11 | | | |
| Additive: | | | |
| powdered uintaite*** | 47.0+ | .0376 | 17.07 |
| water | 47.0+ | .0376 | 17.07 |
| canary yellow dextrin**** | 6.0+ | .0048 | 2.16 |
| emulsifier**. | .1 | .00008 | .036 |
| Additive - Batch 12 | | | |
| Carbon Component: | | | |
| powdered uintaite*** | 47.5+ | .0368 | 16.71 |
| water | 47.5+ | .0368 | 16.71 |
| canary yellow dextrin**** | 5.0+ | .0064 | 2.88 |
| emulsifier**. | .1 | .00008 | .036 |
| Additive - Batch 13 | | | |
| Carbon Component: | | | |
| powdered uintaite*** | 45.0+ | .036 | 16.35 |
| water | 45.0+ | .036 | 16.35 |
| canary yellow dextrin**** | 10.0+ | .008 | 3.6 |
| emulsifier**. | .1 | .00008 | .036 |

+Emulsifier disregarded
**See Ex. 2;
*,**See Ex. 3

The objective physical characteristics of Batches 8–13 were determined to be:

| | Weight (g) | Green Strength (psi) | Dry Strength (psi) | Permeability |
|---|---|---|---|---|
| Ex. | 150 | 8.1 | 12.0 | 433 |
| 8 | 155 | 12.2 | 27.0 | 326 |
| | 160 | 15.2 | 37.0 | 259 |
| | 165 | 19.7 | 48.0 | 202 |
| Ex. | 150 | 8.7 | 6.5 | 403 |
| 9 | 155 | 11.6 | 13.5 | 223 |
| | 160 | 17.3 | 25.0 | 237 |
| | 165 | 20.9 | 28.0 | 199 |
| Ex. | 150 | 8.1 | 16.0 | 418 |
| 10 | 155 | 11.2 | 22.0 | 320 |
| | 160 | 16.3 | 34.5 | 242 |
| | 165 | 20.1 | 39.5 | 198 |
| Ex. | 150 | 8.9 | 10.0 | 408 |
| 11 | 155 | 12.3 | 20.0 | 317 |
| | 160 | 15.5 | 31.0 | 240 |
| | 165 | 18.7 | 33.5 | 200 |
| Ex. | 150 | 8.6 | 12.5 | 389 |
| 12 | 155 | 11.1 | 20.0 | 308 |
| | 160 | 15.1 | 35.0 | 229 |
| | 165 | 19.5 | 42.0 | 192 |
| Ex. | 150 | 11.0 | 19.5 | 345 |
| 13 | 155 | 14.0 | 30.0 | 276 |
| | 160 | 19.9 | 49.0 | 207 |
| | 165 | 23.4 | 59.5 | 170 |

The objective characteristics and workability of batches employing the several concentrations of dextrin were all found to be acceptable and could be satisfactory used in a foundry operation. However, the higher concentrations (Batch 13 in particular) reduce permeability to an extent that could possibly cause a problem. Therefore the moderate concentrations and particularly the 5% concentration of the preferred composition in Example 3.

Variations from the precise compositions of the sand molding media set forth in the examples, accordingly the limits of the invention are set forth in the following claims.

Having thus described the invention, what is claimed as novel and desired to be secured by Letters Patent of the United States is:

1. A sand molding medium comprising, on a weight basis:

| | |
|---|---|
| silica sand | 85%–95% |
| pre-mix | 5%–15% |

wherein the pre-mix comprises:

| | |
|---|---|
| a clay component | 70%–80% |
| a carbon component | 15%–30% |

characterized in that the carbon component includes wettable uintaite.

2. A sand molding medium as in claim 1 wherein the carbon component comprises:

| | |
|---|---|
| sea coal | 25%–85% |
| carbon additive | 15%–75% |

and the carbon additive includes the wettable uintaite.

3. A sand molding medium as in claim 2 wherein the carbon additive comprises:

a dispersion of the wettable uintaite.

4. A sand molding medium as in claim 3 further characterized in that the carbon additive comprises:

| | |
|---|---|
| wettable uintaite | 25%–100% |
| water (emulsified with uintaite) | 0%–50% |
| dextrin | 0%–10% |
| high molecular weight acrylic emulsifier | 0%–.02% |

5. A sand molding medium as in claim 4 wherein further characterized in that the carbon additive substantially comprises the following:

| | |
|---|---|
| wettable uintaite | 47.5% |
| water (emulsified with uintaite) | 47.5% |
| dextrin | 5% |
| high molecular weight acrylic emulsifier | 0.1% |

6. A pre-mix for use in preparing sand molding medium for iron founding, wherein the sand molding medium is to comprise, on a weight basis:

| | |
|---|---|
| silica sand | 85%–95% |
| pre-mix | 5%–15% |

wherein the pre-mix comprises:

| | |
|---|---|
| a clay component | 70%–85% |
| a carbon component | 15%–30% |

characterized in that the carbon component includes wettable uintaite.

7. A pre-mix as in claim 6 wherein the carbon component comprises:

| | |
|---|---|
| sea coal | 25%–85% |
| carbon additive | 15%–75% |

and the carbon additive includes the wettable uintaite.

8. A pre-mix as in claim 7 wherein the carbon additive comprises:

a dispersion of the wettable uintaite.

9. A pre-mix as in claim 8 further characterized in that the carbon additive comprises:

| | |
|---|---|
| wettable uintaite | 25%–100% |
| water (emulsified with uintaite) | 0%–50% |
| dextrin | 0%–10% |
| high molecular weight acrylic emulsifier | 0%–.02% |

10. A pre-mix as in claim 9 further characterized in that the carbon additive substantially comprises the following:

| | |
|---|---|
| wettable uintaite | 47.5% |
| water (emulsified with uintaite) | 47.5% |
| dextrin | 5% |
| high molecular weight acrylic emulsifier | 0.1% |

* * * * *